US005147062A

United States Patent [19]

Heuberger et al.

[11] Patent Number: 5,147,062

[45] Date of Patent: Sep. 15, 1992

[54] PAPER PACK CONTAINER WITH INTERNAL BAG FOR RECEIVING FLUIDS

[76] Inventors: Erich Heuberger, Taxisstrasse 22, D-7925 Trugenhofen; Karl-Josef Ehrhart, Ludwig-Richter-Strasse 40, D-7920 Heidenheim, both of Fed. Rep. of Germany

[21] Appl. No.: 634,149

[22] PCT Filed: May 14, 1990

[86] PCT No.: PCT/EP90/00779

§ 371 Date: Dec. 10, 1990

§ 102(e) Date: Dec. 10, 1990

[87] PCT Pub. No.: WO90/14292

PCT Pub. Date: Nov. 29, 1990

[30] Foreign Application Priority Data

May 16, 1989 [DE] Fed. Rep. of Germany ..... 3915899

[51] Int. Cl.[5] ..... B65D 90/04

[52] U.S. Cl. ..... 220/410; 229/125.15; 220/461; 222/156

[58] Field of Search ..... 229/108, 111, 125.04, 229/125.15, 40; 220/461, 462, 359, 410; 222/105, 156; 206/149, 199

[56] References Cited

U.S. PATENT DOCUMENTS

| | | | |
|---|---|---|---|
| 2,980,304 | 4/1961 | Sisco | 229/125.15 |
| 3,176,902 | 4/1965 | Champlin | 229/40 |
| 3,186,545 | 6/1965 | Conrades | 229/40 |
| 3,670,950 | 6/1972 | Rossi | 229/40 |
| 3,952,940 | 4/1976 | Malcolm | 220/462 |
| 4,165,023 | 8/1979 | Schmit | 222/105 |
| 4,622,693 | 11/1986 | Mykleby | 220/462 |
| 4,830,273 | 5/1989 | Kalberer et al. | 220/359 |
| 4,838,424 | 6/1989 | Petzelt | 220/462 |
| 4,890,772 | 1/1990 | Heuberger et al. | 222/156 |
| 5,048,691 | 9/1991 | Heuberger et al. | 220/462 |

*Primary Examiner*—Stephen Marcus
*Assistant Examiner*—Christopher J. McDonald
*Attorney, Agent, or Firm*—Brooks Haidt Haffner & Delahunty

[57] ABSTRACT

A pack container for liquids is described, comprising an upright folded carton containing an inside bag of plastic material. In its upper region the pack container is slanted on one or two sides to roughly approximate the appearance of a washing concentrate bottle. Optionally the pack container can be provided with a filling and pouring sleeve with a screw cap closure arranged in its head end or it can be opened at one of its slanted sides, whereby zig-zag shaped folded sections of the main surface areas (1, 4) of the folded carton can be uprighted to thus form a pouring opening in which a corner tail of the inside bag is accessible for cutting off.

13 Claims, 8 Drawing Sheets

PAPER PACK CONTAINER WITH INTERNAL BAG FOR RECEIVING FLUIDS

The invention relates to a pack container with an internal bag for receiving fluids, formed from an elongated blank pre-glued along its short side to form a folded carton shell which is uprighted from a collapsed condition to form a tubular body having a rectangular cross-section and featuring a plurality of flaps which by folding and glueing to each other convert the tubular body into a closed elongated folded carton essentially cuboid in shape and featuring two large main panels parallel to each other, connected together by side surface areas extending vertically from the former, together with a liquid-tight tube of a plastic film arranged in said carton shell and featuring a weld running at a right angle to the elongation of the blank, the ends of which are closed off by welds running in the direction of the elongation of the blank.

One such pack container has already been put on the market by the Applicant.

Containers of the above kind serve to package liquids as a replacement for collations of plastic or tin. A pack container of this kind can be fed to a packaging machine preglued as a collapsed folded carton in which a plastic tube is inserted. The packaging machine uprights the collapsed folded carton, seals the plastic tube contained therein and closes the carton by folding and glueing its flaps in place.

The container is filled before the plastic tube is sealed and the folded carton shell is closed or—when a closure sleeve is provided prior to the plastic tube being sealed—after the plastic tube is sealed and after closing the folded carton shell by the closure sleeve.

The advantage of folded cartons having an internal bag is that they require very much less plastic material for receiving a givén quantity of fluid than a plastic bottle of corresponding filling volume and that they can be collapsed together very easily after use, thus making their disposal considerably more facilitated than that of plastic bottles or tin cans.

With domestic detergents there is now a trend towards liquid concentrates which are replacing more and more the earlier conventional washing powders.

Due to the mass consumption of these products there is a requirement for a suitable and, in particular, environmentally-compatible package especially since in this sector, package recycling has been unable to become established as compared to that of the beverages sector.

The object of the invention is to create a paper pack container having an internal bag for receiving fluids of the type as aforementioned which has the external appearance of a bottle and which can be easily manufactured, filled and emptied.

This object is attained by a pack container having the characteristics defined in the opening paragraph of the specification, wherein

- the main surface areas are slanted in the upper region on at least one of its neighbouring longitudinal sides to roughly half of the amount of elongation, forming a trapezoidal profile in this region,
- on the slanting edges of the main panels upper side flaps are provided, folded vertical to the main surface areas,
- on the non-slanted edges of the longitudinal sides of the main surface areas lower side flaps are provided, folded vertical to the main surface areas and glued to each other.

On at least one of the lowerside flaps a cover flap is provided which is located on the upperside flaps, and on the head panel shortened by the slanting of the main panels, flaps are provided located over at least a part of the cover flaps.

The invention relates to a pack container which stands upright more or less in the form of a bottle and in which normally liquid washing concentrates are sold. Bottles of this type generally feature a slim shape having substantially an oval or rectangular cross-section which tapers towards the top. Slanting at least one of the longitudinal edges of the main panels of the pack container clearly defines the "top" and "bottom" of the container, it approximating the shape of a usual washing concentrate bottle to favourably influence the decision to buy of the consumer.

The invention makes it possible to provide the blanks in thru-production with the internal bag material which is produced from a flat web of plastic film (foil) since the weld for forming a tube from the film web runs in the same direction as that of the thru-feed of the blank following preglueing into a collapsed folded carton i.e. stamping, adding the plastic tube, folding and preglueing of the blank can all be done in a single operation on a thru-production machine. It is essential for the folded carton to be provided with a pouring or sealing sleeve that no weld of the internal bag is located in the area in which the sleeve is to be provided, i.e. at the top of the pack container since this could detriment the tight seal of the sleeve on the internal bag.

The invention permits creation of pack containers provided with a filling and pouring sleeve on to which a screw cap can be screwed as well as the creation of pack containers in which a pouring opening is formed by releasing a glued flap of the folded carton pulling forward one side wall section of the same and cutting off the resulting exposed corner of the internal bag. Pack containers of the latter kind are intended in particular for such applications in which the contents are to be emptied completely in a single operation, for example, for filling up another container.

The invention can further be embodied that only one of the side edges of the main panels of the pack container is designed slanting, thus producing overall an unsymmetrical shape of the pack container. Shapes of this kind can also be seen in commercially available plastic bottles receiving washing concentrates. On the other hand, the invention also permits providing slanting edges on both sides of the aforementioned main panel to create a container which is overall symmetrically shaped. Furthermore, it is possible to provide slanting edges in the lower region of the folded carton comparable to those in the upper region, thus enabling a pack container to be produced having 8-cornered main panels.

In conclusion, the invention also achieves the object in which the upper region of the folded carton is provided with rounded shoulders on both sides of the head to constitute to this extent a correspondingly shaped bottle by a paper pack having an internal bag.

The invention will now be detailed on the basis of the example embodiments with reference to the drawings in which.

Figure 1A:
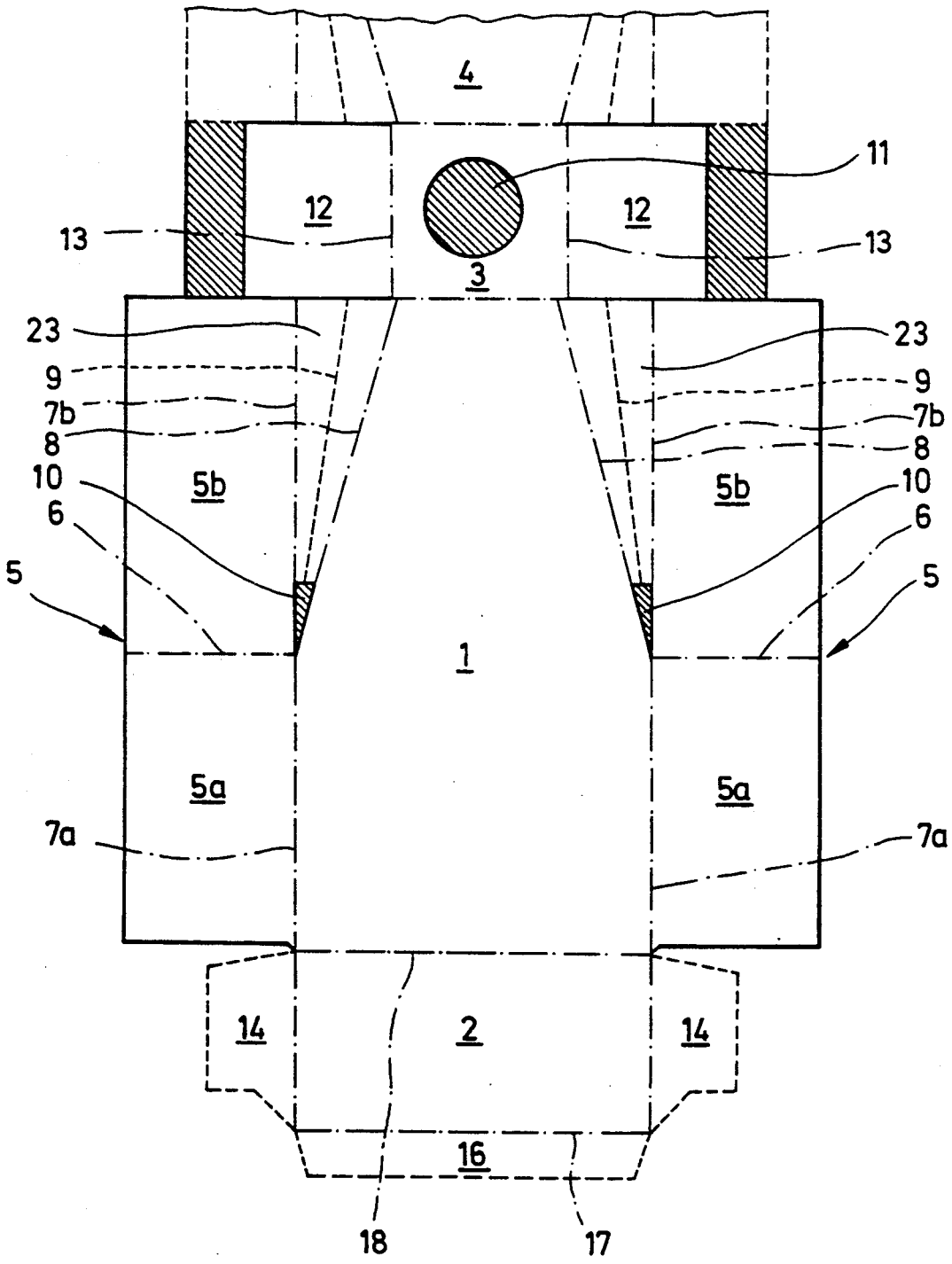
FIG. 1A and FIG. 1B show a collapsed, preglued blank for one embodiment of a folded carton for a pack container according to the invention.

FIG. 1A shows by the solid lines one side of a blank glued to become a collapsed folded carton for a pack container according to the invention. It should be noted that the sections shown by the dotted line in FIG. 1A relative to the preglued, collapsed folded carton correspond to the same sections on the other side of the blank. In addition, the parts of the blank located on the other side rendered visible by sections are shown shaded in FIGS. 1A and 1B.

Figure 1B:
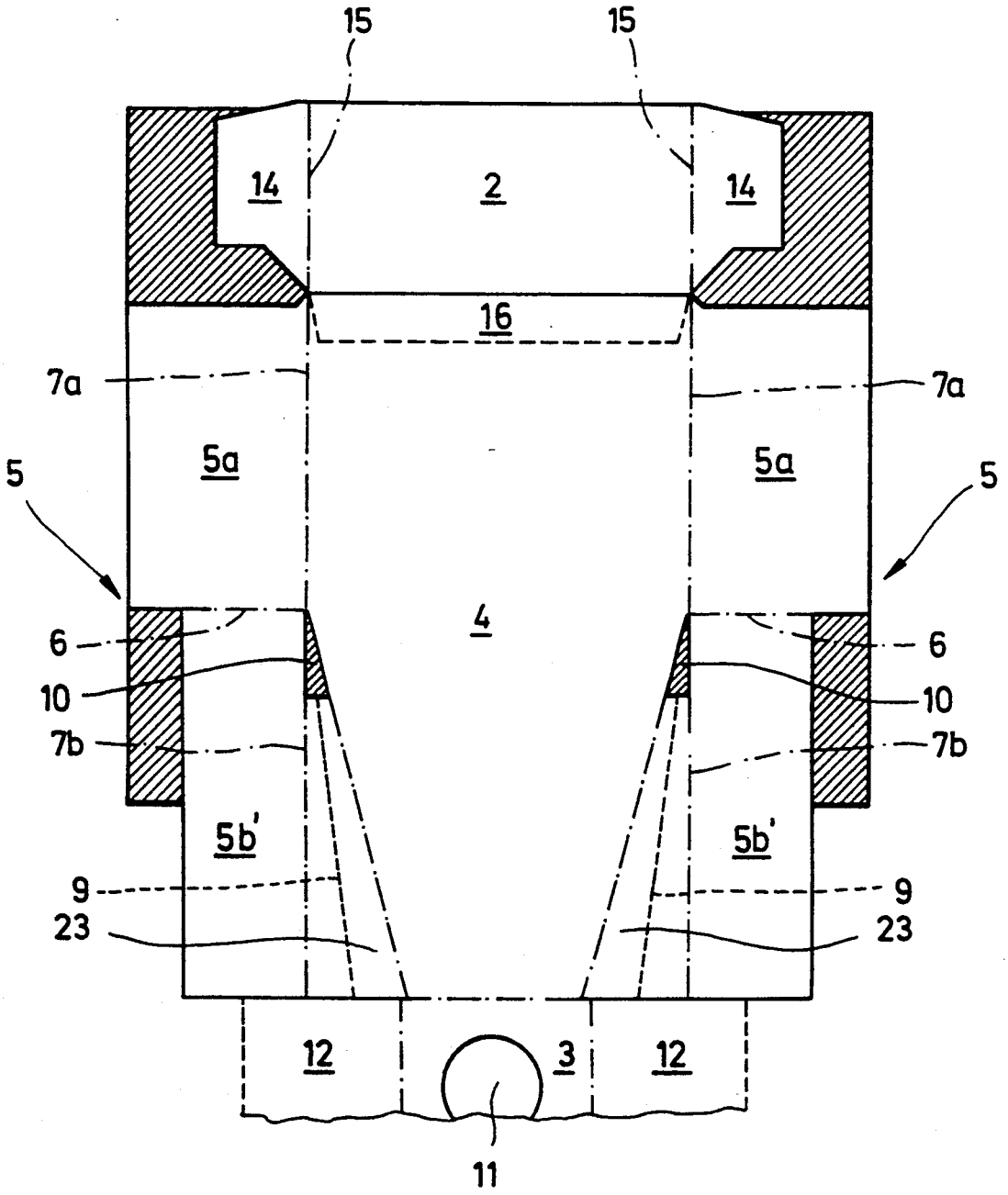

Furthermore, the dash-dotted lines in FIGS. 1A and 1B indicate fold lines along which the corresponding parts of the blank are folded back from the plane of the drawing shown in FIG. 1A when the folded carton is uprighted and closed. Short dashed lines represent the fold lines along which a fold materializes forward from the plane of the drawing when the carton is uprighted.

FIG. 1A shows a main panel 1 of rectangular shape. To the bottom of the main panel 1 a bottom panel 2 is provided which in the preglued condition of the collapsed folded carton is located on the rear side of the configuration as shown in FIG. 1A, it thus being indicated here by dotted lines (viz. FIG. 1B). At the opposite end of the main panel 1 a head panel 3 is provided which in the useful condition of the pack container forms its top. On the side of the head panel facing away from the main surface area 1 a second main panel 4 corresponding to that if 1 is provided, as shown in FIG. 1B, which is located on the other side of the blank as shown in FIG. 1A. The bottom panel 2 is firmly glued to the edge located at the top of the second main panel 4 shown in FIG. 1B which is located at the bottom of the pack container when uprighted in the finished condition for use.

In summary the blank of a preglued, collapsed folded carton shows on one side the main panel 1 and the head panel 3 each having side flaps (to be described) and on the other side, the second main panel 4 together with the firmly glued bottom panel 2 each having flaps protruding to the side (also to be described). It will be appreciated that this preglued blank can be uprighted to form a tubular body of rectangular cross-section which can be closed by folding the aforementioned flaps into place. The main panel 1 is provided on both sides with a side flap 5. Each of these side flaps 5 features a lower section 5*a* and a cover section 5*b* at its top which are parted from each other by a pressed-in fold line 6 which is cross-running. The side flaps 5 are each parted from the main panel 1 by fold lines 7*a* and 7*b*. The fold line 7*a* extends from the bottom end of the main panel 1 to the position at which the cross-running fold line 6 ends. In an extension of this fold line 7*a* the fold line 7*b* extends up to the top end of the main panel 1. From the point of connection of the fold lines 6, 7*a* and 7*b* separate fold lines 8 each slant inwardly into the main panel 1, each fold line 8 making an angle of roughly 15°. In the line halving the angle between these two fold lines 7*b* and 8 a fold line 9 is provided which is shown short-dashed in FIG. 1 at which a fold is made in the opposite direction to that of fold line 7*b* and 8. A triangular sector 23 delimited by the fold lines 7*b* and 8 features in the area in which these two fold lines meet, this sector forming an upper side flap. A cutout 10 through which the rear side of the second main panel 4 is visible in the example as shown.

The two fold lines 8 slanting into the main panel 1 form the limits of a region at the top end of the main panel 1 where the head panel 3 joins the main panel 1. In the example shown, the head panel 3 has roughly a square section and features an opening 11 for receiving a filling and pouring sleeve. The sides of the head panel 3 are each provided with flaps 12 which are parted from the head panel 3 by the fold lines 13.

The configuration of the second main panel 4 and of the side flaps provided on the latter panel is substantially the same as that of main panel 1, this being the reason why, with the exception of the main panel itself, the same reference numerals are used. It should be noted, however, that the cover flaps 5*b* somewhat slimmer than the lower side flaps 5*a*.

The bottom panel 2 features two bottom side flaps 14, which are parted from the bottom panel 2 by fold lines 15, and a cross-running preglueing flap 16 intended for glueing to the edge of the rear side of the second main panel 4 and which is parted from the bottom panel 2 by a fold line 17. The bottom panel 2 is parted from the main panel 1 by a fold line 18.

To receive a fluid in the pack container to be produced from the blank, the collapsed blank features a plastic tube which is open at both ends (not shown in FIGS. 1A and 1B) and glued or welded to the insides of the blank, particularly in the area around the opening 11 and which in the collapsed condition of the folded carton is open at both ends. The two open ends are located under flaps 5*a* and 5*b*, and a weld for forming this plastic tube from a flat film blank runs approximately level with the cross-running fold line 6, i.e. across and under one of the main panels 1 and 4. In the area of the head panel 3 there is thus no weld of the plastic tube.

Figure 2:
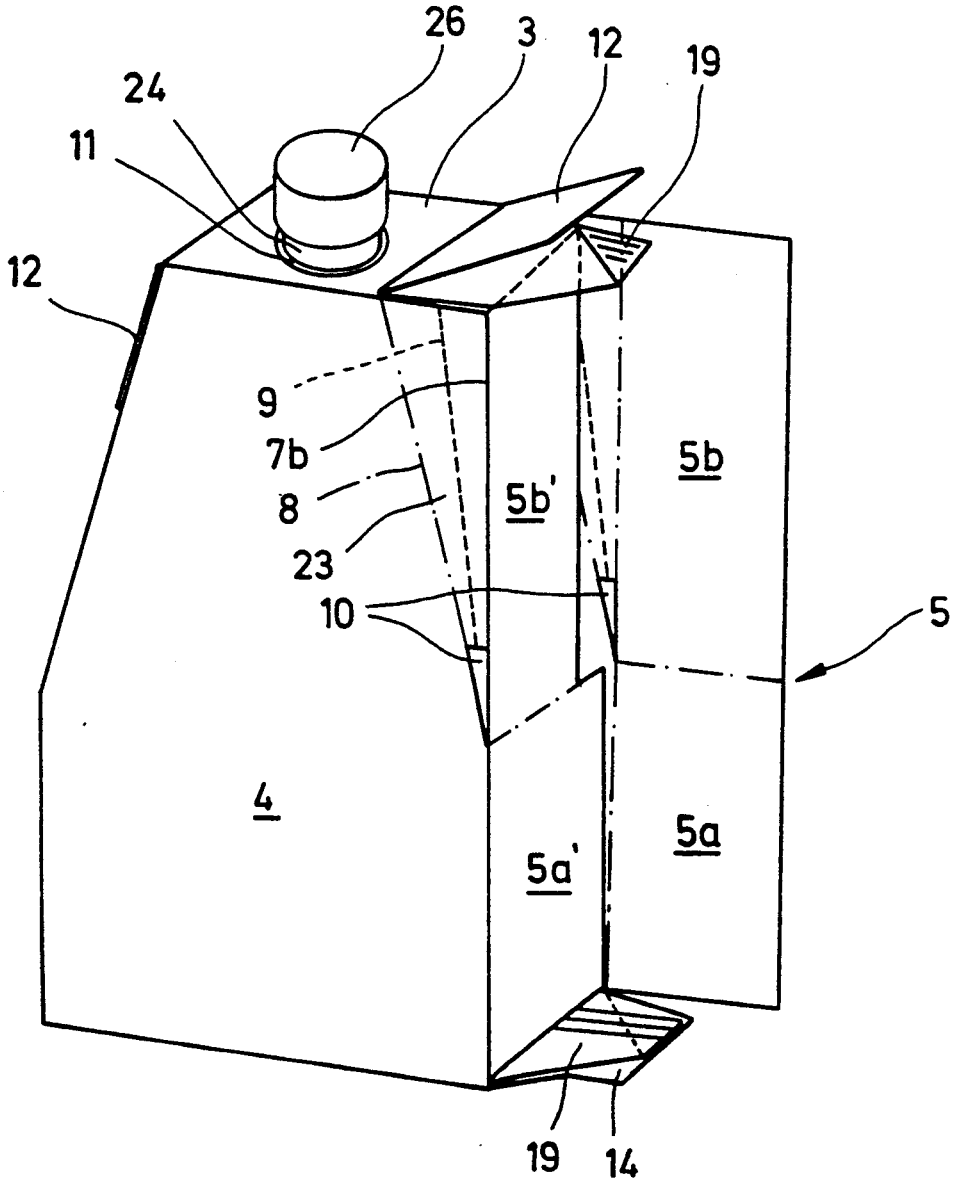
FIG. 2 is a schematic perspective view of a pack container produced from the blank as shown in FIG. 1 in the partially complete condition.

To form a pack container having a filling and pouring sleeve the collapsed blank is first of all uprighted and the aforementioned sleeve which has a collar extending radially from its base, is attached and sealed on the inside to the plastic tube, the plastic film forming the plastic tube is punctured and removed in the area of the opening 11. The fully fitted sleeve is identified by 24 in FIGS. 2 and 3 and shown with the cap 26 screwed in place. Then the plastic tube is welded closed at its two open edges. This is followed by the side flaps 5, the coverflaps 5*b*' of which are configured slimmer, being folded to assume the condition as shown in FIG. 2 on the right. In this arrangement the end tail 19 of the internal bag protrudes from the interior of the uprighted folded carton beyond the bottom and top ends of said side flaps 5 as shown in FIG. 2. The bottom side flaps 14 of the bottom panel 2 are then each folded upwards together with the attendant tail end of the bag 19 as shown in FIG. 2. The next thing is to fold the other side flaps 5 (shown in FIG. 2 as still being open) on to the already folded side flaps 5 and said side flaps 14 provided at the bottom panel 2 and now folded upwards which is then glued thereon as well as on the lower side flap 5*a* located underneath. The cover upflap 5*b* and 5*b*' are also glued together, whereby the top corner tail 19 of the internal bag continues to protrude outwards.

Figure 3:
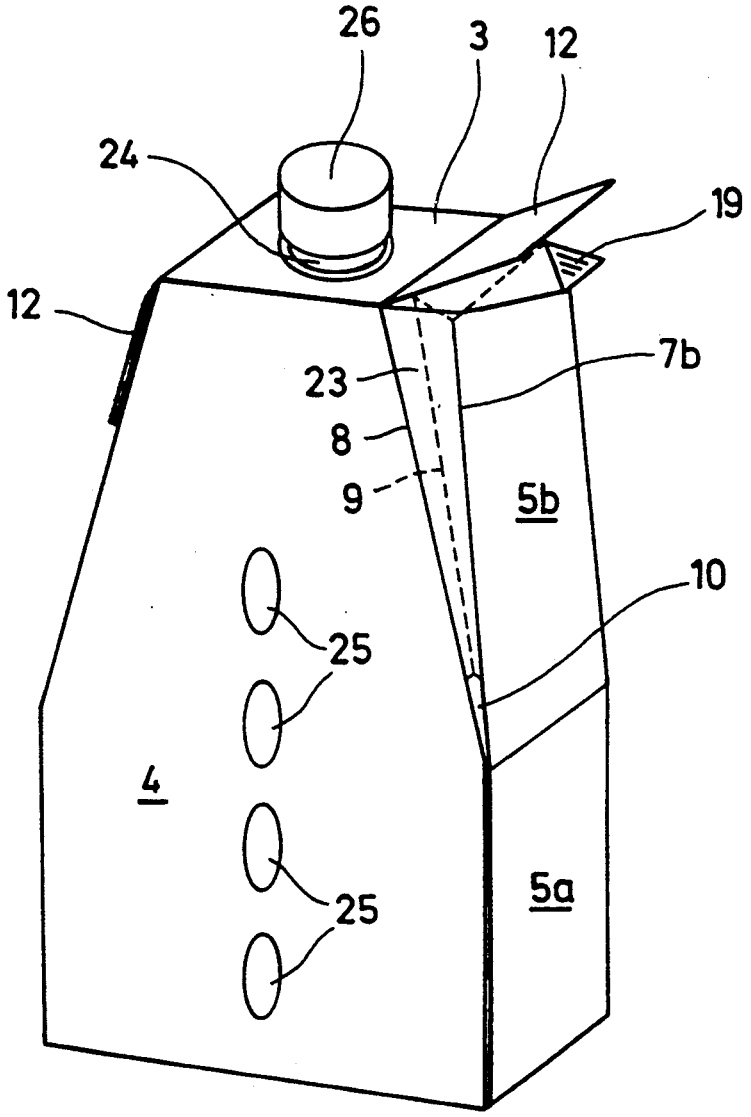
FIG. 3 is a perspective view of a pack container according to the FIGS. 1 and 2 in a later, partially complete condition.

This is followed by—with reference to FIG. 3—pressing in the cover flaps 5*b* and 5*b*', said cover flaps being located one on the other, against the remaining body of the pack container so that sectors 23 forming the upper side flaps and delimited by the fold lines 7*b* and 8 respectively then zig-zag fold inwards. The cutouts 10 serve to facilitate inwards zig-zag folding of these sectors 23. By pressing in the cover flaps 5*b* and 5*b*' against the body of the pack container the latter receives a slanted configuration in the upper section, as illustrated on the left of FIG. 2 showing the completed condition. In conclusion, the side flaps 12 provided on the head panel 3 together with the upper tail ends 19 of the bag located underneath are each folded down and firmly glued to the cover flap sections 5*b*. The completed condition can be seen on the left of FIG. 2.

In this way a pack container is formed having a substantially trapezoidally-shaped side section from which the presence of an internal bag is not apparent at first sight. The internal bag is, at best, apparent by peeping through the openings 10, otherwise it is covered by the side flaps.

The completed pack container can now be filled from above through the filling and pouring sleeve and then closed off by application of a screw cap.

At least one of the main surface areas of the folded carton can, as shown in FIG. 3, be preferably provided with a row of openings 25 through which the filling level in the internal bag can be monitored.

It should be noted that when zig-zag folding the upper side flaps formed by sectors 23 to form a carton fold, which provides the pack container its trapezoidal section, the head panel 3 and the flaps 5 which are glued together, ensure adequate stability with respect to the forces of pressing in. The already pressed-in fold lines 9 facilitate this zig-zag folding procedure.

Figure 4:
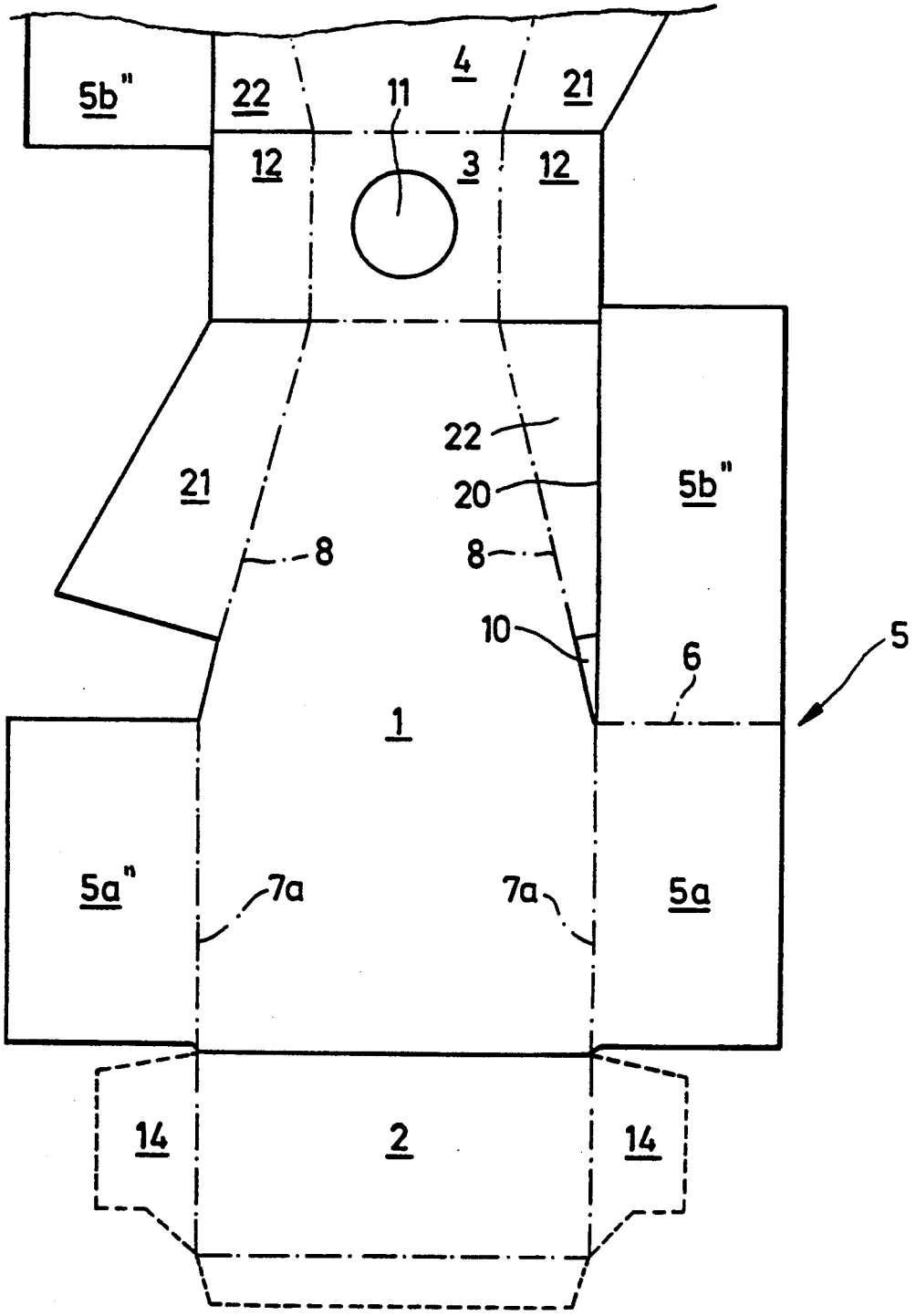
FIG. 4 is a partial view of another embodiment of a folded carton blank.

FIG. 4. shows an alternative embodiment of a blank, i.e. as a section thereof. The configuration as shown in FIG. 4 can be compared to that of FIG. 1A, it depicting a modified configuration of the main panel 1 with its side flaps. The second main panel and its corresponding side flaps is indentical in configuration and thus needs neither describing nor illustrating.

The embodiment according to FIG. 4 differs from that of FIG. 1 in that the configuration of a zig-zag shaped fold through sector 23 as used in carton folding as defined by the fold lines 7*b*, 8 and 9 in FIG. 1A is not provided. Instead, as can be seen from FIG. 4, the top section 5*b*'' of a side flap 5 applied to one side of the main panel 1 is parted with respect to the main panel 1 by a cut 20 and said section 5*b*'' has a length corresponding to the length of the slanting fold line 8. The side flaps 12 provided on the head panel 3 must thus be correspondingly shorter, as indicated by FIG. 4. From the line connecting the fold lines 6 and 7*a* which completely correspond to those according to FIG. 1A a fold line 8 runs at an angle of approx. 15° slanting into the main panel 1 in the direction of the head panel 3 (this also being comparable to the example embodiment according to FIG. 1A) which parts an approximately triangular-shaped upper side flap 22 from the main panel 1. To facilitate folding along this fold line 8 a triangular-shaped cutout 10 is formed in the main panel 1, i.e. where the fold line 8 merges with the point connecting fold lines 6 and 7*a*.

On the other side of the main panel 1 as shown on the left of FIG. 4 the side flap on the main panel 1 comprises in the lower region as parted by fold line 7*a*, merely a lower side flap 5*a*. In the upper region the slanting fold line 8 is joined by an upper side flap 21 which substantially describes an oblique square that is dimensioned so that when it is folded on the uprighted folded carton vertical to the plane described by FIG. 4 it comes up against the substantially triangular-shaped upper side flap 22 as applied to the slanting fold line 8 of the opposing main panel.

Otherwise this blank corresponds to that according to FIGS. 1A and 1B thus doing away with the need for it to be described in detail.

This folded carton is preglued absolutely the same as that shown in FIGS. 1A and 1B and can also be uprighted in the same way, provided with a filling and pouring sleeve, where necessary, and also its internal bag can be sealed in the same way. However, closing off the uprighted folded carton is done differently.

Firstly, the relatively short lower side flap 5*a*'' is folded in place. Before folding the long side flap 5 the upper side flaps 21 and 22 must first be folded along the slanting fold line 8. This sequence can also be changed so that the side flaps 21 and 22 are first folded along the slanting fold line 8 before the lower side flap 5*a*'' is folded, or again, these folding operations can be done simultaneously. In any case the long side flap 5 cannot be folded until the upper side flaps 21 and 22 have been folded. In addition, prior to folding the long side flaps 5 the side flaps 12 provided on the head panel 3 can first be folded downwards and thereby glued, if required, to the upper side flaps 21 and 22, after which, in conclusion, the side flap 5 is folded and its top section 5*b*'' forming a cover flap angled in place and glued to the resulting slanting surface areas. However, it is also possible to glue the side flaps 12 secured to the head panel 3 to the cover flaps 5*b*'' as can be compared to FIG. 2.

As regards folding the bottom side flaps 14 secured to the bottom panel 2 the procedure is the same as shown in the example of FIG. 2.

Folding along the slanting fold lines 8 is also facilitated in this embodiment by cutouts 10.

It will also be appreciated from FIGS. 2 and 3 that it is easily possible to open the pack container depicted there by releasing a side flap 12 secured to the head panel 3 from its contact surface to which it is secured, namely the cover flap 5*b* thus providing access to the tail 19 of the bag where, or also at the cover flaps 5*b* und 5*b*' glued one on the other, the latter can then be pulled forward so that the folded sector 23 forming the upper side flap is uprighted between the fold lines 7*b* and 8. This procedure produces a pouring opening so that after having snipped off the tail 19 of the internal bag the contents of the latter can be emptied very easily.

Figure 5:
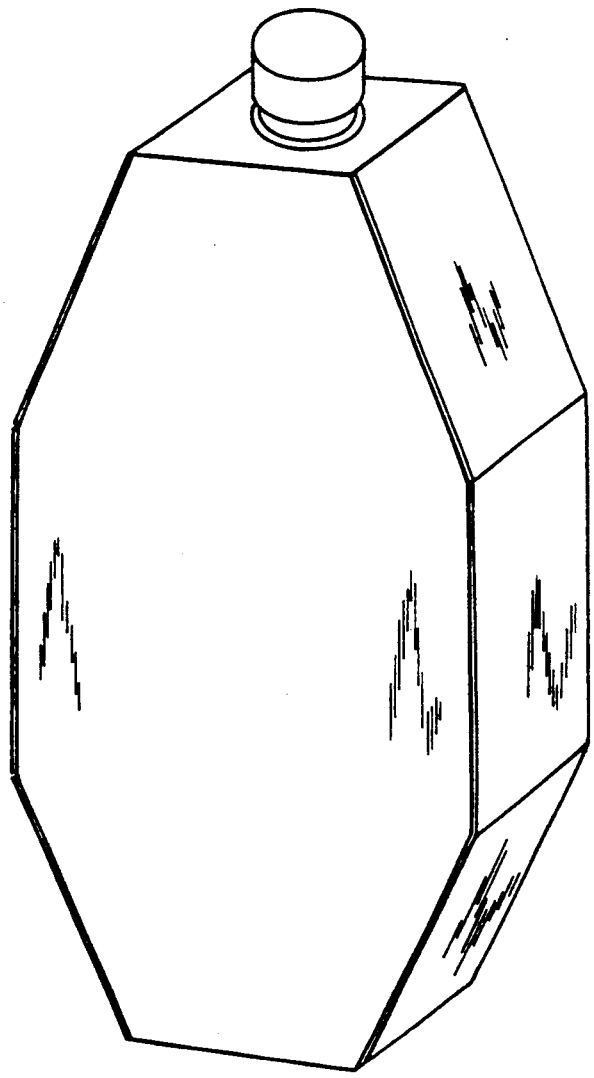
FIG. 5 is a perspective view of a further embodiment of that shown in FIGS. 1 and 3 in which the pack container is slanted on both sides also in the bottom region.

FIG. 5 shows a modified embodiment of the invention according to the FIGS. 1 thru 3. In this embodiment the body of the pack container can also be rendered slanting in the lower region. These slants are formed in just the same way as thus in the upper region by means of suitable fold lines, flaps and folding operations which have already been explained with reference to FIGS. 1 thru 3. It should be noted in this respect that in this case the side flaps 14 can be configured on the bottom panel 2 in the same way as the side flaps 12 on the head panel 3 so that they can be glued from without to the side flaps 5 covering each other.

It should also be noted that the side flaps 12 can be configured so long, when required, that they cover the cover flaps 5*b* over their full length.

Figure 6:
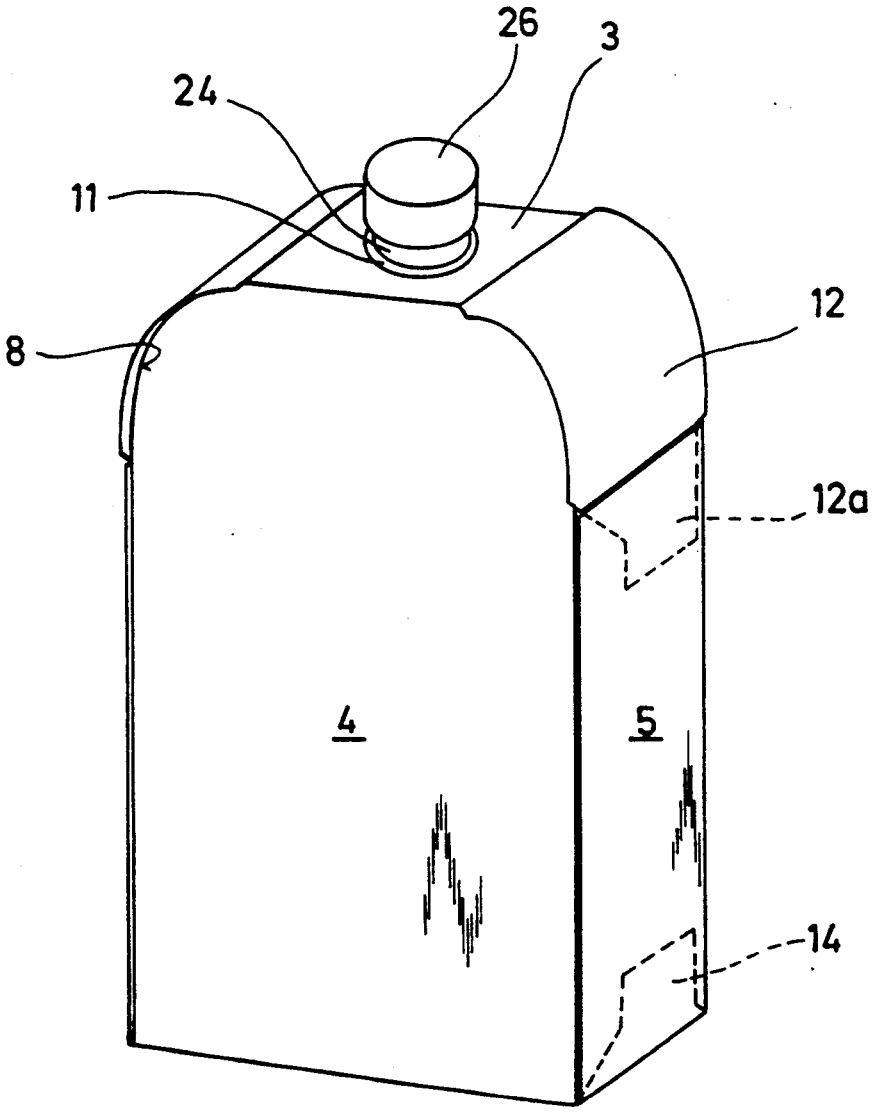
FIG. 6 is a perspective view of an embodiment having rounded shoulders.
Figure 7:
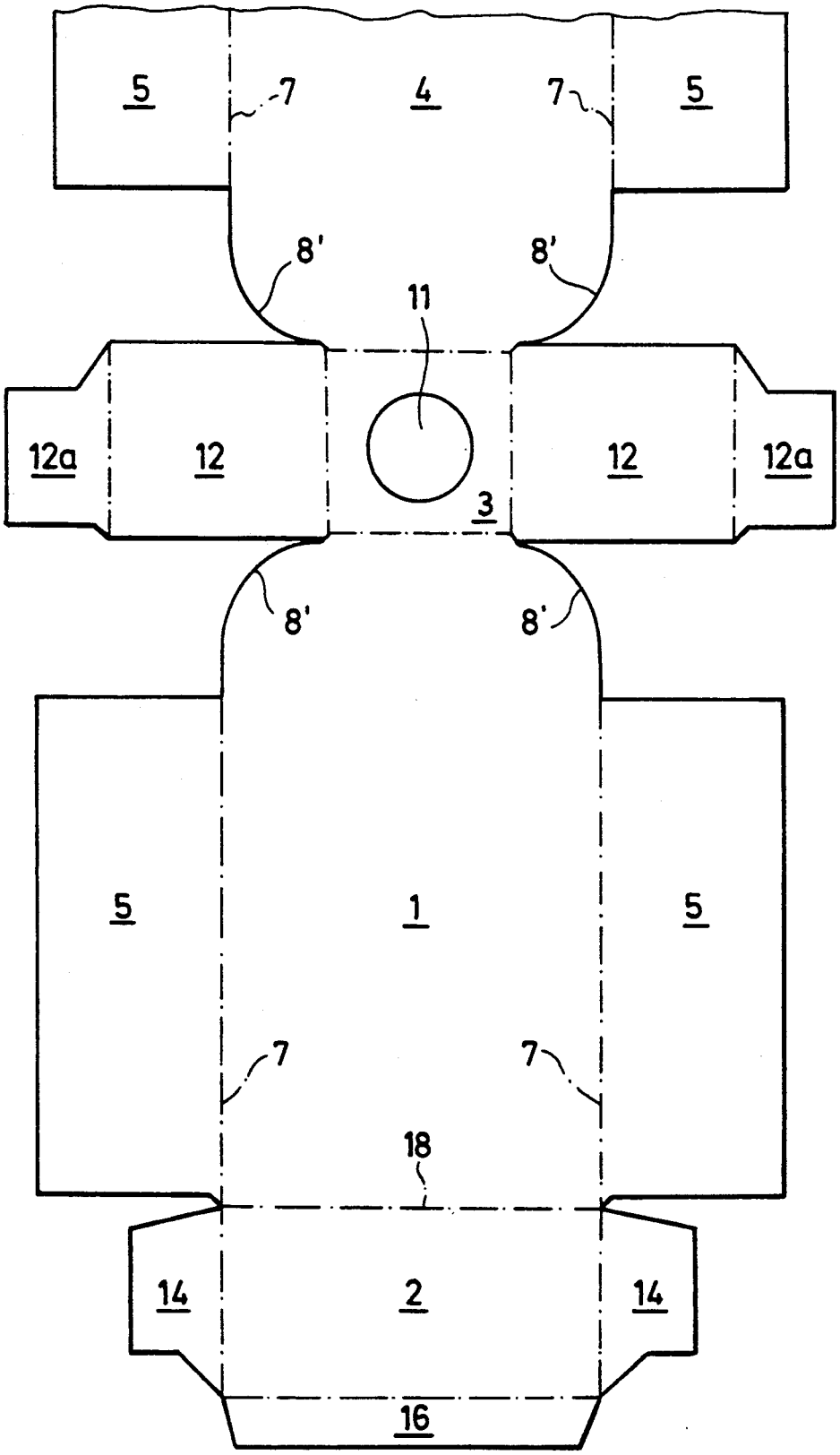
FIG. 7 is a section-view of the blank for the embodiment according to FIG. 6.

FIGS. 6 and 7 show an embodiment of the invention featuring rounded shoulders in the upper area of the pack container. In this shoulder region no side flaps can, of course, be provided on the main surface areas as indicated by the blank in FIG. 7.

The latter has two main panels 1 and 4 which are joined together at their head ends by a head panels 3. The one main panel 1 features a bottom panel 2 at the end facing away from the head panel 3 to which the side flaps 14 and a cross-running glueing flap 16 connect. On the two main panels 1 and 4 side flaps 5 connect on both sides which are parted from the main panels by fold lines 7 and which extend, however, from the bottom end of the main panels 1 and 4 only to the point where separate round edge cutouts 8' are provided, ending in the edges of the head panel 3.

On the head panel 3 side cover flaps 12 are provided, each of which has a length corresponding to the arc length of the round edge sections 8'. The cover flaps are each extended in length by a glueing flap 12*a* which is then glued between the neighbouring side flaps 5 as shown by the dotted lines in FIG. 6.

So that in the upright, fully glued condition of the pack container the facing ends of the round edge sections 8' are reliably covered by the cover flaps 12, the width of the latter is made to be somewhat larger than the depth of the pack container as determined by the dimensions of the head panel 3 or also by the width of the side flaps 5 provided on the main panels 1 and 4.

Otherwise the pack container corresponds to that according to FIGS. 1 and 3 as indicated by the agreement of the corresponding reference numerals. The details identified by these thus need not be again explained here in detail.

In embodiments 5 thru 7 too, the folded carton houses an inside bag which is glued injust the same way as already explained with reference to the FIGS. 1 thru 3, i.e. the collapsed, preglued folded carton can be uprighted without difficulty in the same way, the plastic tube longitudinal seam running at a right angle to one of the main surface areas 1 and 4 so that no seam is present in the area of the filling and pouring sleeve 24.

It should be noted that the various glued positions can be implemented by means of conventional methods, particulary using hot-melt adhesives. The fold lines are impressed as scores in the carton material in the usual way to permit folding and to facilitate it. The material used for the folded carton is the usual paper material as used in general for folded cartons, and the internal bag is of a material which can be welded and is compatible with the received liquid, e.g. low-density polyester which can be coated with a vapor barrier.

What is claimed is:

1. A pack container having an outer shell formed from an elongated carton blank and an inside bag for receiving fluids, said outer shell having two large elongate main panels parallel to each other, defined by longitudinal and transverse edges, respectively, two side surface areas extending vertically from said main panels between same, a bottom panel and a head panel, the two latter each extending between the main panels as well as between the side surface areas, said shell being preglued at a flap provided at a transverse edge common to said bottom panel and one of said main panels and interconnecting said bottom panel and said main panel to form a pre-glued, folded carton which is uprighted from a collapsed condition into a tubular body having a rectangular cross-section, at least one of the longitudinal edges of each main panel having an upper portion to roughly half of the amount of its length running slanted so as to provide the shell with a trapezoidal profile in an upper portion thereof, with the lower portions of said longitudinal edges running parallely to each other, wherein at each one of said lower portions of said longitudinal edges a lower side flap is provided, folded vertically from said main panel, so that the lower side flap provided at one of said main panels covers the lower side flap provided at the other of said main panels and glued thereto, and at each one of said slanted portions of said longitudinal edges an upper side flap is provided, folded vertically from said main panel, so that each upper side flap of one main panel is opposite to a respective upper side flap of the other main panel, so as to form a pair of opposite upper side flaps, and wherein each pair of opposite upper side flaps is covered by a common cover flap extending from an upper end of the outer one of the corresponding lower side flaps and is glued onto said upper side flaps, said cover flaps being in turn partially covered by flaps extending from the head panel and glued onto said cover flaps, and wherein said bag is formed from a liquid-tight tube of a plastic film arranged in said shell and having a weld running parallely to the transverse edges of said main panels, said tube having ends being closed off by welds running parallely to the longitudinal edges of said main panels.

2. A pack container according to claim 1, wherein the upper side flaps each are substantially triangular in shape and are each folded in a fold line halving the angle between a fold line at the respective slating portion of the longitudinal edge of the associated main panel and another fold line at which one of said cover flaps is connected to said upper side flap, so that a zigzag fold is established by each said upper side flap and the associated cover flap, and wherein the flaps povided on the head panel are bonded to the outermost cover flap of the sandwich structure formed by said upper side flaps and associated cover flaps.

3. A pack container according to claim 1 wherein the flaps provided on the head panel are located directly on the upper side flaps and are in turn each covered by one of the cover flaps, respectively.

4. A pack container according to claim 2 wherein the bottom panel is provided with bottom side flaps which are folded each on one of the lower side flaps and covered by the other lower side flap.

5. A pack container according to claim 3 wherein the bottom panel is provided with bottom side flaps which are folded each on one of the lower side flaps and covered by the other lower side flap.

6. A pack container according to claim 4 or 5 wherein a lower corner tail of the internal bag is arranged between each bottom side flap and an associated lower side flap.

7. A pack container according to claim 4 wherein a top corner tail of the internal bag is pulled over an associated cover flap and is in turn covered by one of the flaps provided on the head panel.

8. A pack container according to claim 5, wherein a top corner tail of the internal bag is pulled over an associated cover flap and is in turn covered by one of the flaps provided on the head panel.

9. A pack container according to any of claims 1–5 or claim 7, wherein a triangular cutout is provided in each region of the transition between the slanting portion and the non-slanting portion of the longitudinal edges of the main panels, two sides of said cutouts each running along a fold line and another fold line or cut line respectively.

10. A pack container according to any of claims 1–5 or claim 7, wherein an opening is formed in the head surface area which allows the passage of a closure sleeve which is sealed to the internal bag.

11. A pack container according to claim 10, wherein the closure sleeve is provided with a screw cap.

12. A pack container according to any one of claims 1–5 or claim 7, wherein holes or slits are provided in at least one of the main panels for monitoring the filling level.

13. A pack container according to any one of claims 1–5 or claim 7, wherein the main panels also feature in their lower region on both sides a slanted profile.

* * * * *

UNITED STATES PATENT AND TRADEMARK OFFICE

CERTIFICATE OF CORRECTION

PATENT NO. : 5,147,062

DATED : September 15, 1992

INVENTOR(S) : Erich Heuberger et al

It is certified that error appears in the above-identified patent and that said Letters Patent is hereby corrected as shown below:

Column 3, line 41: "from the main surface area 1 a second" should read: --from the main panel 1 a second--.

Column 4, line 6: "of fold line 7b and 8." should read: --of fold lines 7b and 8.--.

line 25: "flaps 5b somewhat" should read: --flaps 5b are somewhat--.

line 43: "fold line 6, i.e. across" should read: --fold lines 6, i.e. across--.

Signed and Sealed this

Nineteenth Day of October, 1993

Attest:

Bruce Lehman

BRUCE LEHMAN

Attesting Officer

Commissioner of Patents and Trademarks